United States Patent [19]

Glickman

[11] Patent Number: 4,711,599

[45] Date of Patent: Dec. 8, 1987

[54] PAVING BLOCK

[75] Inventor: Michael N. Glickman, London, England

[73] Assignee: McCauley Corporation Limited, London, England

[21] Appl. No.: 805,475

[22] PCT Filed: Mar. 28, 1985

[86] PCT No.: PCT/GB85/00125

§ 371 Date: Nov. 20, 1985

§ 102(e) Date: Nov. 20, 1985

[87] PCT Pub. No.: WO85/04434

PCT Pub. Date: Oct. 10, 1985

[30] Foreign Application Priority Data

Mar. 29, 1984 [GB] United Kingdom ..... 8408129

[51] Int. Cl.[4] ..... E01C 5/00

[52] U.S. Cl. ..... 404/41; 404/42

[58] Field of Search ..... 404/41, 34, 39; 52/311, 52/608

[56] References Cited

U.S. PATENT DOCUMENTS

| | | | |
|---|---|---|---|
| 306251 | 10/1884 | Hayden | 404/39 |
| 447612 | 3/1891 | Jones | 404/34 |
| 2,932,745 | 4/1960 | Alberti et al. | 52/608 X |
| 4,537,001 | 8/1985 | Uppström | 52/311 |

FOREIGN PATENT DOCUMENTS

| | | |
|---|---|---|
| 513766 | 9/1952 | Belgium . |
| 2657809 | 6/1978 | Fed. Rep. of Germany . |
| 8013431 | 2/1981 | Fed. Rep. of Germany . |
| 50031 | 2/1941 | Netherlands . |
| 6607015 | 12/1967 | Netherlands . |
| 9321 | 3/1891 | United Kingdom . |

*Primary Examiner*—Stephen J. Novosad
*Assistant Examiner*—Matthew Smith
*Attorney, Agent, or Firm*—Renner, Otto, Boisselle & Lyon

[57] ABSTRACT

A paving block has six sides, and a top (10) and a bottom surface (12). Two of the side surfaces (14, 16) are substantially parallel and substantially twice as long as each of the other four side surfaces (18, 20, 22, 24), two surfaces (18, 20) of the said other four side surfaces each making an angle of substantially 120° with one end of each of the longer side surfaces (14, 16) and each other side surface (22, 24) making an angle of substantially 60° with the other end of each of the longer side surfaces (14, 16). In other words, a block according to the invention as seen in plan is of 'chevron' shape a shape that could also be termed a squat 'V' shape. This is a simple, easily manufactured block, which permits numerous different arrangements to be laid.

10 Claims, 23 Drawing Figures

FIG. 7
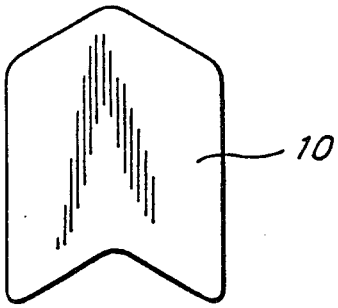
FIG. 8
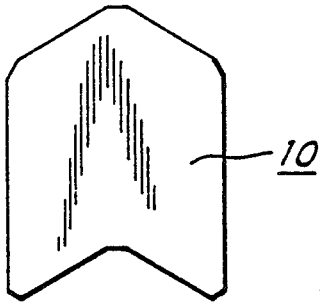
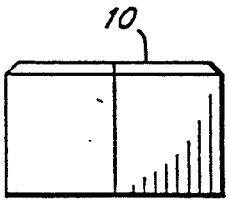
FIG. 9
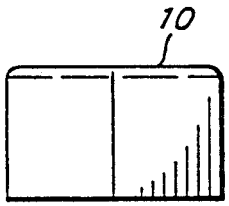
FIG. 10

PAVING BLOCK

This invention relates to a paving block.

Numerous designs of paving block have been proposed for various purposes, but blocks used for decorative paving (whether load bearing or not) have been limited, because of their shapes, in that they can be laid to produce only a few alternative patterns. Indeed, the great majority of prior known blocks can only be laid in such a manner as to produce one, two or three different patterns, configurations or arrangements. An example of a prior block is shown in FIG. 1 and two patterns which it can be laid to produce are shown in FIG. 2. As seen in FIG. 2A, special end blocks are required in addition, if the pattern edge is to be straight. Other suggestions for paving blocks are made in British Patent Specifications Nos. 275,707; 1,200,147 and 1,573,147.

It would be of great assistance to designers, architects, and engineers if a simple, easily manufactured block was available which permitted numerous different patterns to be laid.

According to the present invention, there is provided a paving block having six sides, a top and a bottom surface, characterised in that two of the side surfaces are substantially parallel and substantially twice as long as each of the other four side surfaces, two surfaces of the said other four side surfaces each making an angle of substantially 120° with one end of each of the longer side surfaces, and each other side surface making an angle of substantially 60° with the other end of each of the longer side surfaces.

In other words, a block according to the invention as seen in plan is of "chevron" shape a shape that could also be termed a squat "V" shape. In geometrical terms, the basic module shape of a paving block according to the invention can be looked upon either as eight equilateral triangles or as a regular hexagon to which is attached two equilateral triangles to form a "fishtail" shape added on to the hexagon. The variety of arrangements which can be made is a consequence of the fact that two blocks will juxtapose or inter-relate in an unusually large number of ways.

The invention also provides a paving made with such blocks. One significant technical advantage of such paving is that patterns may be laid which are less prone to opening along aligned joints, because many of the patterns that can be made with blocks according to the invention have broken (i.e. discontinuous) joints at frequent intervals.

A block according to the invention may be square, chamfered or radiused at its edges.

The invention will be better understood from the following description of non-limiting examples, given with reference to the accompanying drawings in which:

FIG. 7 illustrates, in plan view, a second example of block according to the invention, which is similar to the FIG. 3 block except that the corners are radiused;

FIG. 8 illustrates, in plan view, a third example of block according to the invention, which is similar to the FIG. 3 block except that the corners are chamfered;

FIGS. 9 and 10 illustrate, in end elevation, a fourth and a fifth example of block according to the invention, which are similar to the FIG. 3 block except that in one case the edges of its upper surface are chamfered at 45°, and in the FIG. 10 embodiment the edges of its upper surface are radiused;

Figure 1:
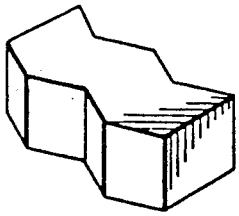
FIG. 1 PRIOR ART
FIG. 1 shows, as stated, one prior art paving block.
Figure 2A:
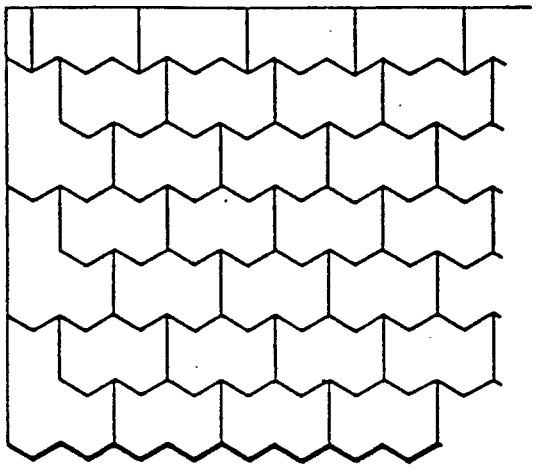
FIG. 2A PRIOR ART
FIGS. 2A and 2B show patterns made having the block of FIG. 1.
Figure 2B:
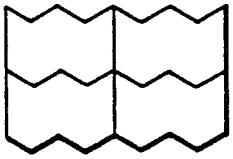
FIG. 2B PRIOR ART
Figure 3:
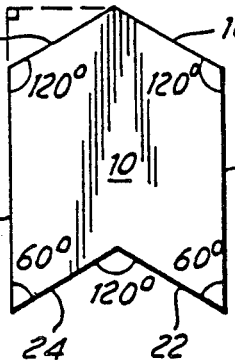
FIG. 3 illustrates in plan one example of block according to the invention.
Figure 4:
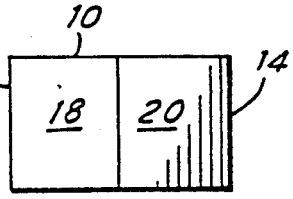
FIG. 4 is an end elevation of the block shown in FIG. 3.
Figure 5:
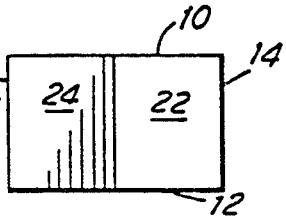
FIG. 5 is an end elevation of the block of FIG. 3 looking at the opposite end from FIG. 4.
Figure 6:
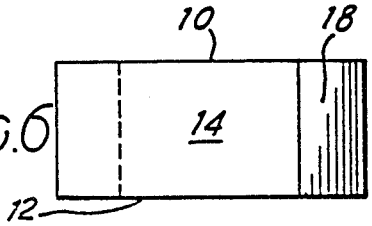
FIG. 6 is a side elevation of the block according to FIG. 3.
Figure 11:
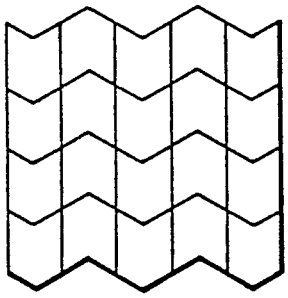
FIGS. 11–22 show 12 examples of paterns which can be made with blocks according to the invention.
Figure 12:
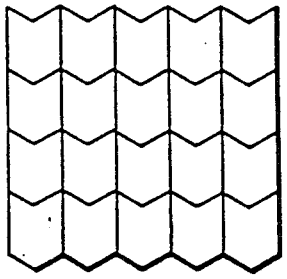

The paving block illustrated in FIG. 3 has a top surface 10, a bottom surface 12, two longer side surfaces 14 and 16, and four shorter side surfaces 18, 20,22 and 24. The block may be solid or hollow. The longer side surfaces 14 and 16 are substantially parallel, as are the top and bottom surfaces 10 and 12. The side surfaces are substantially orthogonal to both the top and bottom surfaces. The length of the side surface 14 is substantially equal to that of the side surface 16 and is substantially twice the length of any one of the other side surfaces 18, 20, 22, or 24. The surface 14 makes an angle of substantially 120° with the surface 18, and a like angle is made between the surfaces 16 and 20. The surface 14 makes an angle of substantially 60° with the surface 22, and a like angle is made between the surfaces 16 and 24. The angle between the surfaces 18 and 20 is substantially 120°, as is the angle between the surfaces 22 and 24. The height of the paving block is at the option of the designer, but it is recommended that it should be at least half the length of the surface 18. The preferred value for the height of the block is that it should be from about 60% to about 150% of the length of the side surface 18.

It can be seen that the basic shape of the block according to the present invention is a hexagon having two equilateral triangles added thereto.

Modifications to the block shape may be made without departing from the invention. For example, the vertical edges may be radiused as shown in FIG. 7. As another example, the vertical edges of the block may be chamfered as illustrated in FIG. 8.

If desired, to give a particular appearance of the paved surface, the edges of the top surface may be chamfered at 45° to the vertical giving a block substantially of the shape illustrated in FIG. 9. As seen in FIG. 10, instead of being chamfered for example at 45°, the edges of the top surface 10 may be radiused.

Figure 13:
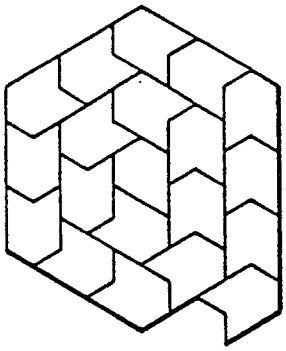

In contrast to prior art designs of block, blocks according to the invention may be made to give rise to a wide variety of different patterns, configurations or arrangements. Some of these patterns are shown in FIGS. 11–22, of which FIG. 11 can be termed an unbroken joint (2 way) pattern, FIG. 12 can be termed an unbroken joint (1 way) pattern and FIG. 13 illustrates a single spiral pattern. A feature of this particular pattern is that a specially cut block is required to start at the centre.

Figure 14:
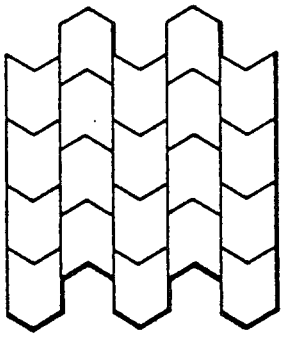
Figure 15:
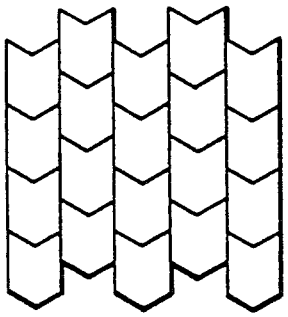
Figure 16:
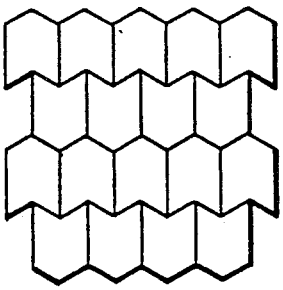
Figure 17:
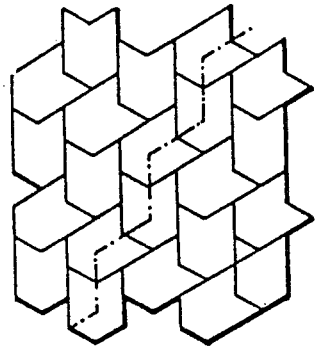
Figure 18:
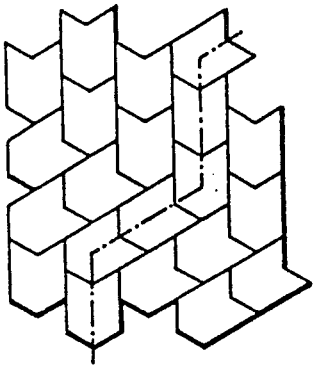
Figure 19:
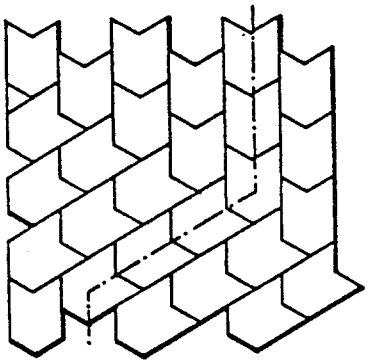
Figure 20:
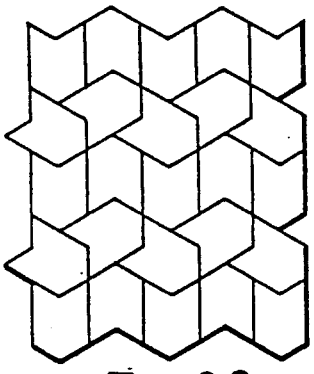
Figure 21:
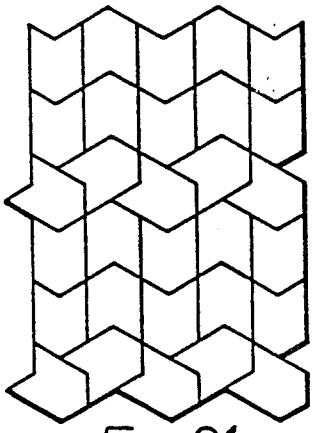
Figure 22:
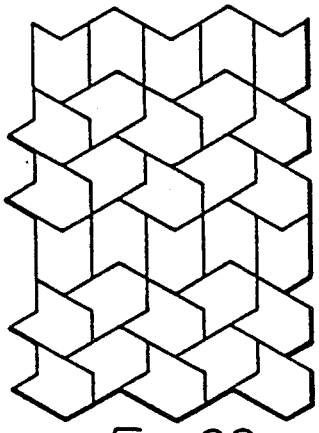

FIGS. 14, 15 and 16 show three further patterns, one being a broken joint (2 way), FIG. 15 being a broken joint (1 way) and FIG. 16 being a broken joint (double axis). These arrangements, and those of FIGS. 17–22 have an important technical advantage in that due to the broken joint configuration, the likelihood of cracking is greatly reduced, and also the ability of the paving to bear shocks or loads generally in the direction of the plane of its surface is increased. The remaining patterns illustrated can be readily understood from an inspection of the Figures, and can be named as follows:

FIG. 17—Staggered line (1 pitch)
FIG. 18—Staggered line (2 pitch)
FIG. 19—Staggered line (3 pitch)
FIG. 20—Double pattern (1+1)
FIG. 21—Double pattern (2+1)
FIG. 22—Double pattern (1+2)

This invention also provides a method of creating a paved surface by laying such blocks using conventional laying techniques.

What is claimed is:

1. A paving block having six side surfaces, a substantially planar top surface and a substantially planar bottom surface, said top and bottom surfaces being substantially at right angles to each one of said side surfaces, said six side surfaces including two longer side surfaces of essentially equal length and four shorter side surfaces of essentially equal length, said longer side surfaces being essentially parallel and essentially twice as long as said shorter side surface, two of said shorter side surfaces being located at one end of said longer side surfaces and essentially making an angle of 120° with respective ones of said longer side surfaces, and the other two of said shorter side surfaces being located at the other end of said longer side surfaces and essentially making an angle of 60° with respective ones of said longer side surfaces.

2. A paving block as set forth in claim 1 having at least one edge which is chamfered.

3. A paving block as set forth in claim 1 having at least one edge which is radiused.

4. A paving block as set forth in claim 1 which is hollow.

5. A paving block as set forth in claim 1 which is solid.

6. A paving block as set forth in claim 1 having at least one vertical corner edge which is chamfered.

7. A paving block as set forth in claim 1 having a height within a range of substantially 60% to substantially 150% of the length of said shorter side surfaces.

8. Paving comprising an array of blocks as set forth in claim 1, said blocks having sides thereof in juxtaposition with respective sides of adjacent blocks.

9. A paving block having a substantially planar top surface, a substantially planar bottom surface, and six side surfaces extending between said top and bottom surfaces substantially at right angles thereto, said six side surfaces including two essentially parallel and essentially equal length longer side surfaces and two pairs of shorter side surfaces of essentially equal length at respective ends of said longer side surfaces, the shorter side surfaces of one pair thereof intersecting one another essentially at an angle of 120° therebetween and respective ones of said longer side surfaces essentially at an angle of 60° therebetween, the shorter side surfaces of the other pair thereof intersecting one another essentially at an angle of 120° therebetween and respective ones of said longer side surfaces essentially at an angle of 120°, and said longer side surfaces being essentially twice as long as said shorter side surfaces.

10. Paving comprising a plurality of paving blocks as set forth in claim 9, said paving blocks having sides thereof in juxtaposition with respective sides of adjacent paving blocks.

* * * * *